US008887861B2

(12) United States Patent
Regier et al.

(10) Patent No.: US 8,887,861 B2
(45) Date of Patent: Nov. 18, 2014

(54) MANIPULATED VORTEX WAVEGUIDE LOUDSPEAKER ALIGNMENT

(71) Applicants: Stephen David Regier, Piper City, IL (US); Thomas Michael Ewers, Kankakee, IL (US)

(72) Inventors: Stephen David Regier, Piper City, IL (US); Thomas Michael Ewers, Kankakee, IL (US)

( * ) Notice: Subject to any disclaimer, the term of this patent is extended or adjusted under 35 U.S.C. 154(b) by 0 days.

(21) Appl. No.: 13/972,508

(22) Filed: Aug. 21, 2013

(65) Prior Publication Data

US 2014/0060959 A1 Mar. 6, 2014

Related U.S. Application Data

(60) Provisional application No. 61/695,988, filed on Aug. 31, 2012.

(51) Int. Cl.

| | |
|---|---|
| ***H04R 1/02*** | (2006.01) |
| ***H04R 1/28*** | (2006.01) |
| *H04R 27/00* | (2006.01) |
| *H04R 1/26* | (2006.01) |

(52) U.S. Cl.

CPC *H04R 1/02* (2013.01); *H04R 27/00* (2013.01); *H04R 1/26* (2013.01); *H04R 1/2857* (2013.01)

USPC ..... 181/155; 181/199; 381/348

(58) Field of Classification Search

CPC ..... H04R 1/02; H04R 1/26; H04R 1/2857

USPC ..... 181/155, 156, 199; 381/345, 348, 349, 381/350, 386

See application file for complete search history.

(56) References Cited

U.S. PATENT DOCUMENTS

| | | | | |
|---|---|---|---|---|
| 5,111,905 | A * | 5/1992 | Rodgers | 181/152 |
| 6,744,902 | B2 * | 6/2004 | Proni | 381/386 |
| 7,046,816 | B2 * | 5/2006 | Vandersteen | 381/182 |
| 8,406,444 | B2 * | 3/2013 | Wang | 381/335 |
| 2008/0130932 | A1 * | 6/2008 | Schultz | 381/337 |
| 2009/0065293 | A1 * | 3/2009 | Moore | 181/192 |

* cited by examiner

*Primary Examiner* — Jeremy Luks

(57) ABSTRACT

A manipulated vortex waveguide loudspeaker alignment that provides frequency independent amplification and projects with even dispersion and signal correlation from both sides of the transducer. The loudspeaker of the present invention may include a housing that contains a driver baffle that supports at least one transducer. The present invention may further include pressure baffles, waveguide baffles, and output flare baffles arranged within the housing to project amplified sounds with reflection resistance.

14 Claims, 4 Drawing Sheets

MANIPULATED VORTEX WAVEGUIDE LOUDSPEAKER ALIGNMENT

CROSS-REFERENCE TO RELATED APPLICATION

This application claims the benefit of priority of U.S. provisional application No. 61/695,988, filed Aug. 31, 2012, the contents of which are herein incorporated by reference.

BACKGROUND OF THE INVENTION

The present invention relates to a speaker and, more particularly, to a manipulated vortex waveguide loudspeaker alignment.

Conventional loudspeaker alignments produce correlated auditory waves which are highly subject to interaction with themselves as they are reflected from surrounding surfaces as well as line of sight impediments. The wave front is further subject to cancellations, node reinforcement, comb filtering effects, and room nodes as it interacts with the wave front of other conventional loudspeaker alignments. This results in reduction of auditory clarity and uneven dispersion.

Other issues that occur with conventional loudspeakers may include the following. The Energy from one side of the transducers is only marginally utilized in usable full sound spectrum reproduction in reinforcement of the signal from the other side of the transducers. Conventional loudspeaker alignments are subject to loss of auditory energy as a function of distance. Traditional loudspeaker designs force tune loudspeaker transducers, artificially limiting frequency response.

In order to overcome adverse reactions, conventional loudspeaker alignments require complex amounts of control equipment as well as carefully controlled placement of the loudspeaker cabinets.

As can be seen, there is a need for an improved loudspeaker.

SUMMARY OF THE INVENTION

In one aspect of the present invention, a manipulated vortex waveguide loudspeaker alignment. comprises: a driver baffle having a first end and a second end, wherein the driver baffle comprises at least one opening shaped to support an audio transducer; a first output flare baffle and a second output flare baffle, wherein the first output flare baffle is connected with the driver baffle near the first end, wherein the second output flare baffle is connected with the driver baffle near the second end; a first waveguide baffle and a second waveguide baffle, wherein the first waveguide baffle is connected with the first output flare baffle, wherein the second waveguide baffle is connected with the second output flare baffle, wherein the first and second waveguide baffle extend towards each other, wherein a gap is formed in between the first waveguide baffle and the second waveguide baffle; and a pressure baffle mounted in between the driver baffle and the waveguide baffles, wherein a gap is formed between the pressure baffle and the first output flare baffle, and a gap is formed between the pressure baffle and the second output flare baffle.

These and other features, aspects and advantages of the present invention will become better understood with reference to the following drawings, description and claims.

DETAILED DESCRIPTION OF THE INVENTION

Figure 1:
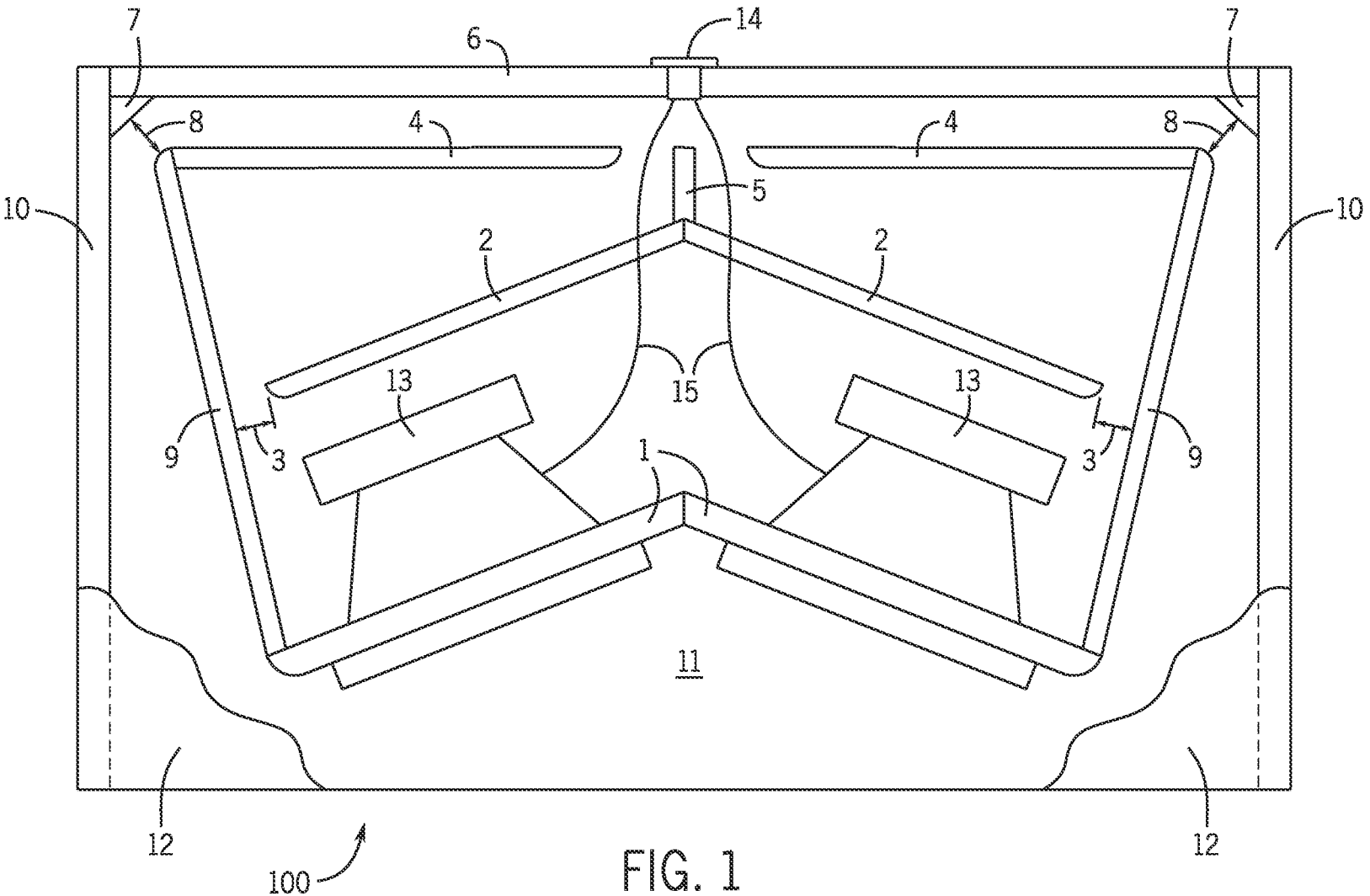
FIG. 1 is a top plan view with the top panel broken away from the housing of a first embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a manipulated vortex waveguide loudspeaker alignment that provides frequency independent amplification and projects with even dispersion and signal correlation from both sides of the transducer. The loudspeaker of the present invention may include a housing that contains a driver baffle that supports at least one transducer. The present invention may further include pressure baffles, waveguide baffles, and output flare baffles arranged within the housing to project amplified sounds with reflection resistance.

The present invention may include a manipulated vortex waveguide loudspeaker alignment with de-correlated sound and carrier wave output which is reflection resistant while allowing the sound to wrap around objects inside the vortex event horizon. The production of many small slightly time shifted signals, also referred to as de-correlation, inside the wave front does not provide a large enough single wave amplitude to cause perceptible adverse wave interactions.

Utilizing continuum mechanics, energy from one side of the transducers is harvested, re-energized, time aligned, and reintroduced to the signal from the other side of the transducer. The manipulated vortex waveguide loudspeaker alignment produces a multisource signal which combines and reaches equilibrium within the surrounding space at a distance from the loudspeaker. This results in minimal sound pressure loss before decaying into the conventional loss paradigms of a traditional loudspeaker alignment. Further, the manipulated vortex waveguide loudspeaker does not forcibly tune the transducer allowing each transducer to extend to its Fs frequency.

The vortex manipulated vortex waveguide loudspeaker alignment provides frequency independent amplification and summing of both sides of the transducer for greater dynamic range, response smoothing, wide even dispersion, and signal de-correlation providing life like sound with a vortex event horizon for extended near field response characteristics. The de-correlated signal from multiple manipulated vortex waveguide loudspeakers in stereo alignment provides lifelike auditory imaging.

Referring to the Figures, the present invention may include a manipulated vortex waveguide loudspeaker alignment. The manipulated vortex waveguide loudspeaker alignment may have a plurality of baffles. The baffles may include a driver baffle 1, output flare baffles 9, waveguide baffles 4, and a pressure baffle 2. The present invention may further include a housing 100. The housing 100 may house and support the baffles of the present invention.

In certain embodiments, the housing 100 may have sides 10, including a first side 10 and a second side 10, a bottom panel 11, a top panel 12, and a back panel 6. The housing 100 may form a front opening. A gap 8 may be formed in between the waveguide baffles 4 and the back panel 6. A gap 8 may be formed between the sides of the housing and the output flare baffles 9. In certain embodiments, the housing 100 may further include a connector 14 and wires 15 to connect to the transducer 13. The housing 100 may further include a plurality of corner reflectors 7 mounted to the corners within the housing 100.

The driver baffle 1 may include a first end and a second end with at least one opening shaped to support an audio transducer 13. The driver baffle may be oriented closest to the front opening, so that the transducer 13 may be facing towards the front opening.

In certain embodiments, the output flare baffles 9 may include a first output flare baffle 9 and a second output flare baffle 9. The first output flare baffle 9 may be connected to the driver baffle 1 near the first end. The second output flare baffle 9 may be connected to the driver baffle 1 near the second end.

The waveguide baffles 4 may include a first waveguide baffle 4 and a second waveguide baffle 4. The first waveguide baffle 4 may be connected to the first output flare baffle 9 and the second waveguide baffle 4 may be connected to the second output flare baffle 9. In certain embodiments, the first and the second waveguide baffles 4 may extend from the output flare baffles 9 towards one another. A gap may be formed in between the first waveguide baffle 4 and the second waveguide baffle 4.

The present invention may further include the pressure baffle 2. The pressure baffle 2 may be mounted in between the driver baffle 1 and the waveguide baffles 4. A gap 3 may be formed in between the pressure baffle 2 and the first output flare baffle 9 and a gap 3 may be formed in between the pressure baffle 2 and the second output flare baffle 9.

As illustrated in FIG. 1, the present invention may include a first driver baffle 1 and a second driver baffle 1. In certain embodiments, the first driver baffle 1 may include a first opening formed to receive a first transducer 13 and the second driver baffle 1 may include a second opening formed to receive a second transducer 13. In certain embodiments, the present invention may further include a panel support 5 mounted in the middle of the pressure baffle 2, forming a first pressure baffle 2 and a second pressure baffle 2.

In certain embodiments, the first driver baffle 1 and the second driver baffle 1 may be at an angle relative to one another. The first pressure baffle 2 and the second pressure baffle 2 may also be at an angle relative to one another, so that the pressure baffles 2 and the driver baffles 1 are substantially parallel to one another. In certain embodiments the output flare baffles 9 may be at an angle relative to the sides 10, such that the output flare baffles 9 are angled inward from the back panel 6. The waveguide baffles 4 may be substantially parallel with the back panel 6.

Figure 2:
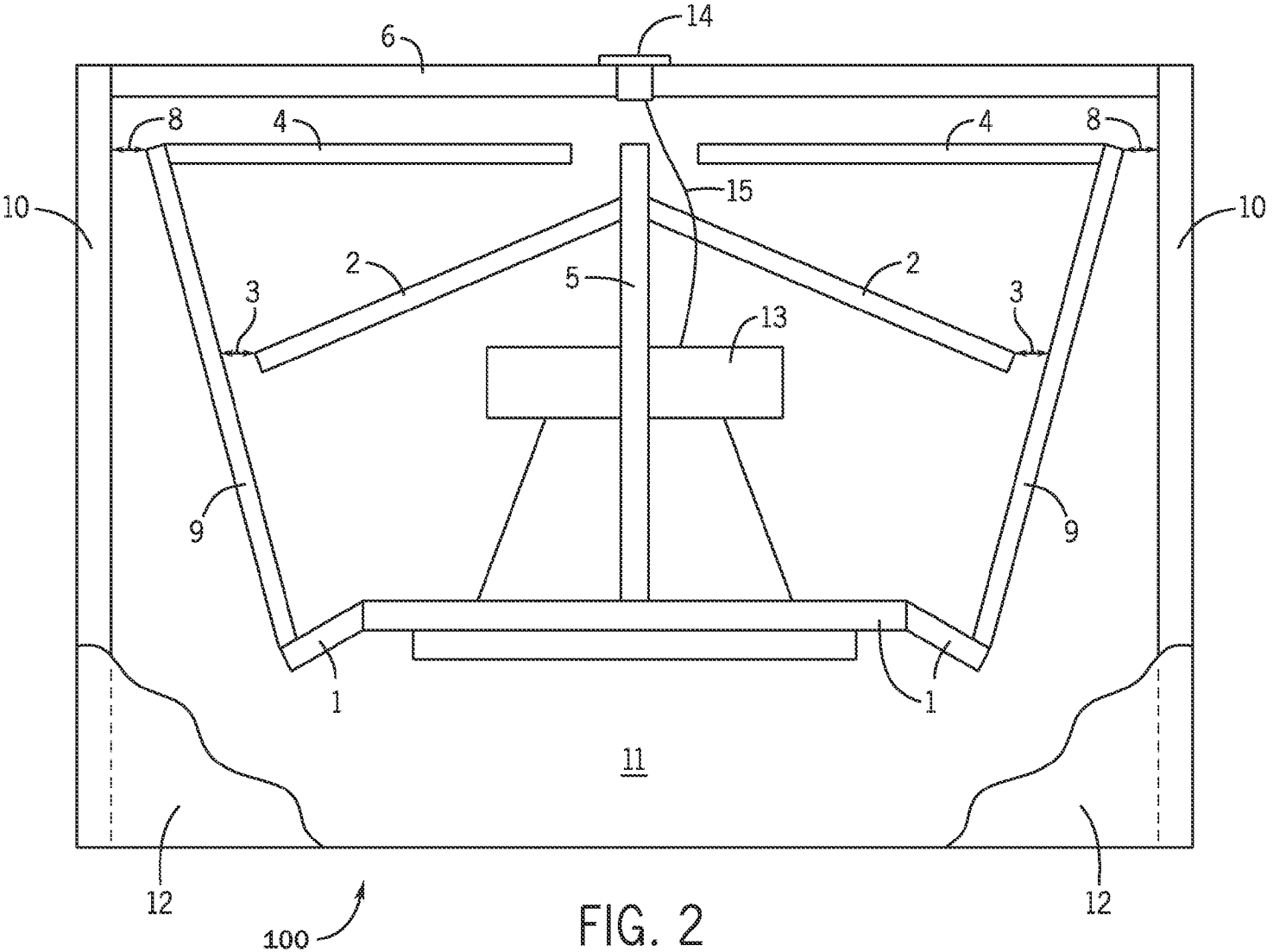
FIG. 2 is a top plan view with the top panel broken away from the housing of a second embodiment of the present invention.

As illustrated in FIG. 2, the driver baffle 1 may include only one opening formed to support an audio transducer 13. The panel support 5 may run through the middle of the transducer 13, separating the housing into two portions. In certain embodiments, the driver baffle 1 may be substantially parallel with the back panel 6. In certain embodiments, the first side of the driver baffle 1 and the second side of the driver baffle 1 may be angled relative to the driver baffle 1.

Figure 3:
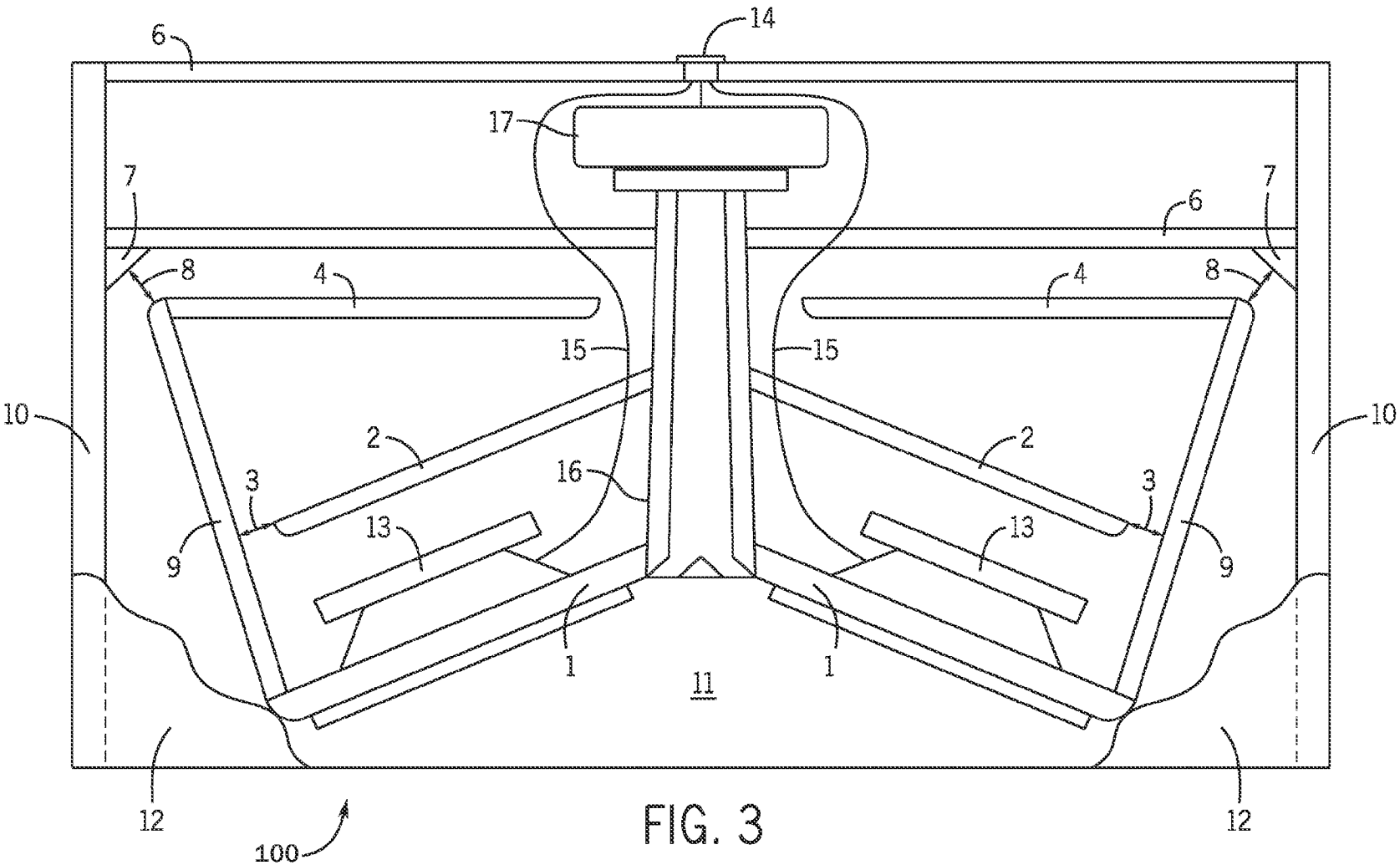
FIG. 3 is a top plan view with the top panel broken away from the housing of a third embodiment of the present invention.

As illustrated in FIG. 3, the present invention may include a high frequency waveguide 16 and a high frequency transducer 17. In certain embodiments, the high frequency waveguide 16 may run down the middle of the present invention, separating the first and second driver baffles 1, the first and second pressure baffles 2, and the first and second waveguide baffles 4. The high frequency transducer 17 may be attached to the high frequency waveguide 16 near the back of the housing 100. In certain embodiments, the high frequency waveguide 17 may be housed between two back panels 6 in a separate housing.

Figure 4:
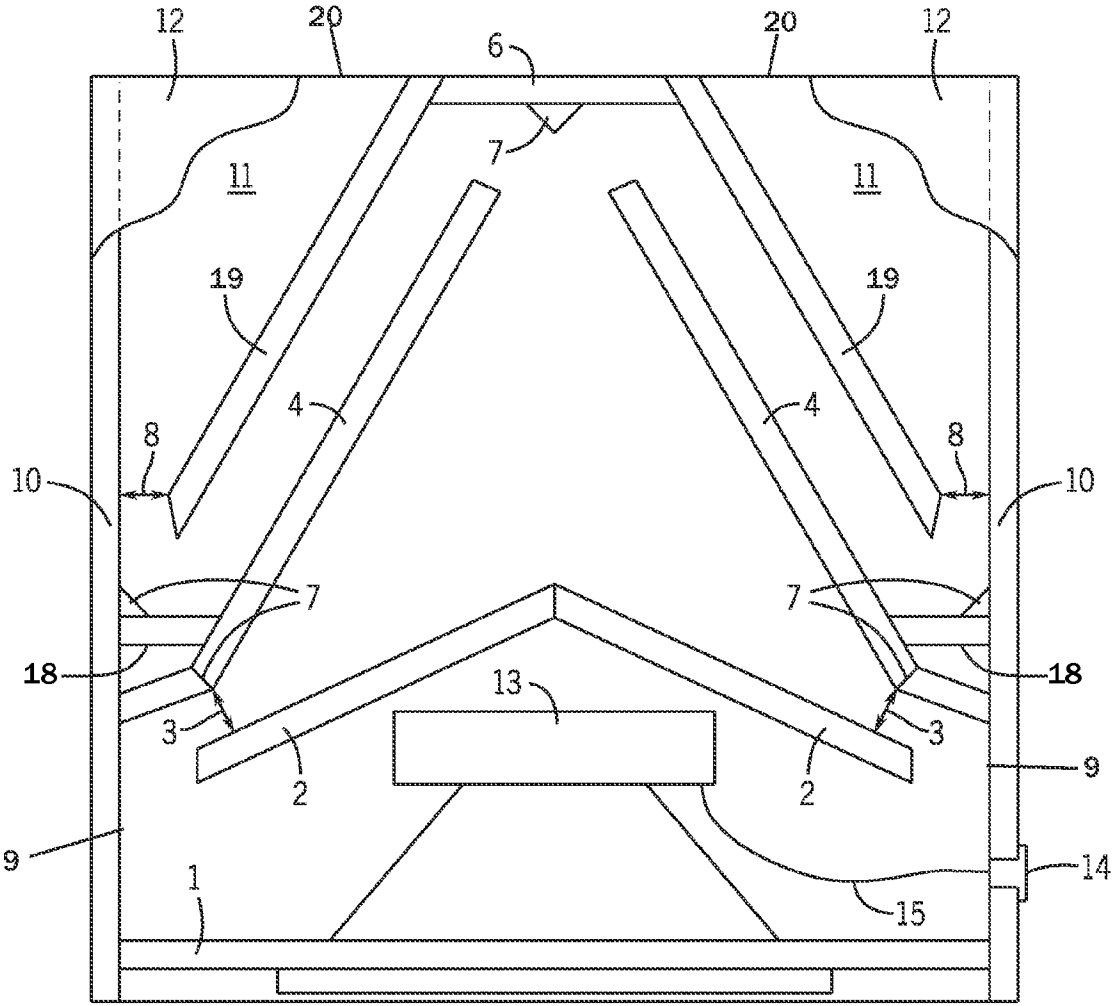
FIG. 4 is a top plan view with the top panel broken away from the housing of the fourth embodiment of the present invention.

As illustrated in FIG. 4, driver baffle 1 may extend from the side 10 to the second side 10 of the housing. The back panel 6 may further include inward extending buffer panels 19. A gap 8 may be formed in between the inward extending baffle panels 19 and the waveguide baffles 4, as well as in between the inward extending panels 19 and the sides 10 of the housing. Therefore, a channel opening 20 may be formed from the inside of the housing to the outside of the housing between the back panel 6 and the sides 10. In certain embodiments, the present invention may further include side reflectors 18 attached to the waveguide baffles 4 and the sides 10 of the housing. The present invention may further include corner reflectors 7 between the back panel 6 and the side reflector 18.

In certain embodiments, the front of the audio transducer (s) 13 and the driver baffles 1 may form a scoop. The driver baffles 1, pressure baffles 2, and output flare baffles 9 may form the driver chamber for the audio transducers 13. The pressure baffle gaps 3 may be formed by the slot between the pressure baffle 2 and the output flare baffle 9. The vortex generator may be formed by the back of the pressure baffles 2, output flare baffles 9, front of the waveguide baffles 4, and the panel support 5. The waveguide may be formed by the back of the waveguide baffle 4, the back panel 6, the sides 10, and the corner reflectors 7. The output flare gaps 8 may be formed between the smallest points between the output flare baffles 9 and the sides 10. The output flare may be formed by the cabinet sides 10 and output flare baffle 9 and may open to the front opening of the housing.

The scoop may allow the audio transducers 13, which are driven by an electrical signal via the wiring 15 and connector 14, to load and interact with all audio sources present in the front of the loudspeaker. This provides a wide even dispersion with minimal node and anti-node behavior and helps neutralize the audio transducers 13. The driver chamber may be designed to provide proper volume of air and physical alignment of driver in relation to the pressure baffle gap 3 to produce high pressure wave energy without destabilization of the audio transducers 13. The pressure baffle aperture 3 may be constructed to introduce in a controlled manner the high pressure energy from the driver chamber into the low pressure side of the vortex generator. The vortex generator may amplify the audio signal and may be constructed to allow each frequency to find its own natural path without force tuning or eliminating any portion of the audio signal while forcing it under compression as it reaches the panel support 5 and turns into the waveguide. The waveguide may direct the high pressure output of the vortex generator and allow the continued buildup of energy to the output flare gaps 8 which may be the terminus of the waveguide. The waveguide may also provide time correction to prevent cancellation once the audio signal is reintegrated. The output flare gap 8 may terminate the waveguide and control the exit of the high pressure waveguide into the output flare.

The output flares may direct and control the time corrected and de-correlated high pressure energy produced in the waveguide. Once the energy leaves the loudspeaker it may be controlled by the surrounding modes of the environment in which the loudspeaker is placed. This allows the vortex event horizon to form in relation to loudspeaker capacity and output versus environment modes thus allowing the manipulated vortex waveguide loudspeaker to self-adjust to the environment in which it was placed.

Additional components may be included, such as center mounted high frequency horns and flying hardware. As illustrated in FIG. 3, a high frequency transducer 17 may be added in the rear of the loudspeaker entering into the waveguide 16. The loudspeakers may be constructed in a trapezoidal build profile to allow flying in "J" formation or lean back angles as required. The present invention may include multiple horizontally arranged transducers 13 in each side of sectioned driver baffles 1 for center channel duty in home theater applications or addition of high frequency tweeters.

The design allows for half of the loudspeaker layout to be built utilizing only one driver for size considerations, generally sub-woofers. As mentioned above, a single flat baffle 1 may be substituted for the original driver baffles 1 of the manipulated vortex waveguide alignment with a provided setback from the end of the output flare baffles for single driver applications. A single driver alignment may also be constructed with combined vortex generators and rear firing output flares for narrower physical cabinets and rear boundary loading The manipulated vortex waveguide loudspeaker alignment may aid the hearing impaired through non-conventional auditory stimulation. Further, the manipulated vortex waveguide loudspeaker alignment may be able to be reconfigured as a high output infra-sonic output transmission device.

The following may include a method of making the present invention. The housing dimensions may be based from physical dimensions as well as electromechanical specifications of the specific audio transducers selected. The top and bottom panels may be built parallel to each other. All other baffles and panels may be arranged perpendicular to them. The driver baffles and pressure baffles may be set parallel to each other and join at a crossing angle of approximately 19-25 degrees. The output flare baffles and waveguide baffles attach to each other and then to the driver baffles. The spacing of the output flare baffle to the pressure baffle defines the pressure baffle gap. The support panel may be attached to the back of the joint of the pressure baffle and may define the entrance to the waveguide. The housing back spacing may set the waveguide width dimension and connects to the rear of the side panels. In the corner of the housing back panel and side panels, the corner reflectors may be set. The driver baffles may have cutouts for the audio transducers to allow for front mounting and wiring run to the connector in rear of the housing.

The following may be a method of using the present invention. The manipulated vortex waveguide loudspeaker alignment may be typically used in a traditional manner, however, with lessened regard towards the placement issues which plague sound reproduction devices found in common use today. The manipulated vortex waveguide loudspeaker alignment may also be used in non-traditional settings with lessened regard for audio performance loss such as passing high frequency around objects with clarity even with a fully obstructed line of sight or placement near boundaries which would normally cause adverse interaction. Other settings may also include decoupling from the ground plane which traditionally can cause severely diminished low frequency output. The expansive near field effect inside the vortex event horizon of the manipulated vortex waveguide loudspeaker alignment, defined as the collapse of the decorrelated sound field into the correlated sound field at the Near-Far to Far-Field transition dependent on power level, size, number and frequency output, allows for lower initial audio sound pressure level near the loudspeakers while preserving audio energy transmission to the audience. The present invention may also be employed in sound reproduction of electrified and acoustic instruments.

It should be understood, of course, that the foregoing relates to exemplary embodiments of the invention and that modifications may be made without departing from the spirit and scope of the invention as set forth in the following claims.

What is claimed is:

1. A manipulated vortex waveguide loudspeaker alignment comprising:

a driver baffle having a first end and a second end, wherein the driver baffle comprises at least one opening shaped to support an audio transducer;

a first output flare baffle and a second output flare baffle, wherein the first output flare baffle is connected with the driver baffle near the first end, wherein the second output flare baffle is connected with the driver baffle near the second end;

a first waveguide baffle and a second waveguide baffle, wherein the first waveguide baffle is connected with the first output flare baffle, wherein the second waveguide baffle is connected with the second output flare baffle, wherein the first and second waveguide baffle extend towards each other, wherein a gap is formed in between the first waveguide baffle and the second waveguide baffle; and a pressure baffle mounted in between the driver baffle and the waveguide baffles, wherein a gap is formed between the pressure baffle and the first output flare baffle, and a gap is formed between the pressure baffle and the second output flare baffle.

2. The manipulated vortex waveguide loudspeaker alignment of claim 1, further comprising a housing comprising a first side, a second side, a bottom panel, a top panel, and a back panel, wherein the housing forms a front opening, wherein the driver baffle, the first and second output flare baffles, the first and second waveguide baffles, and the pressure baffle are mounted within, wherein the driver baffle is oriented closest to the front opening.

3. The manipulated vortex waveguide loudspeaker alignment of claim 2, wherein a gap is formed in between the waveguide baffles and the back panel and a gap is formed between the sides of the housing and the output flare baffles.

4. The manipulated vortex waveguide loudspeaker alignment of claim 2, wherein the housing further comprises a connector and wiring configured to connect with the transducer.

5. The manipulated vortex waveguide loudspeaker alignment of claim 2, further comprising a plurality of corner reflectors mounted to a plurality of corners within the housing.

6. The manipulated vortex waveguide loudspeaker alignment of claim 1, further comprising a panel support mounted in the middle of the pressure baffle, forming a first pressure baffle and a second pressure baffle.

7. The manipulated vortex waveguide loudspeaker alignment of claim 6, wherein the at least one opening comprises two openings, wherein the driver baffle is configured to support two transducers.

8. The manipulated vortex waveguide loudspeaker alignment of claim 7, wherein the driver baffle comprises a first driver baffle and a second driver baffle.

9. The manipulated vortex waveguide loudspeaker alignment of claim 8, wherein the first driver baffle and the second driver baffle are at an angle relative to one another, and the first pressure baffle and the second pressure baffle are substantially parallel to the first driver baffle and the second driver baffle.

10. The manipulated vortex waveguide loudspeaker alignment of claim 1, further comprising an audio transducer mounted within the opening.

11. The manipulated vortex waveguide loudspeaker alignment of claim 1, further comprising a high frequency waveguide.

12. The manipulated vortex waveguide loudspeaker alignment of claim 1, further comprising a high frequency transducer.

13. The manipulated vortex waveguide loudspeaker alignment of claim 2, wherein the driver baffle extends from the first side to the second side of the housing.

14. The manipulated vortex waveguide loudspeaker alignment of claim 13, wherein the back panel further comprises inward extending baffle panels, wherein a gap is formed between the inward extending baffle panels and the waveguide baffles, and a gap is formed between the inward extending panels and the sides of the housing, thereby forming a channel opening from an inside of the housing to an outside of the housing between the back panel and the sides of the housing.

* * * * *